US007762440B2

(12) United States Patent
Cook

(10) Patent No.: US 7,762,440 B2
(45) Date of Patent: Jul. 27, 2010

(54) ERGONOMIC DUTY BELT

(75) Inventor: Clifton Cook, Boise, ID (US)

(73) Assignee: Tactical Design Labs, Inc., Boise, ID (US)

( * ) Notice: Subject to any disclaimer, the term of this patent is extended or adjusted under 35 U.S.C. 154(b) by 1367 days.

(21) Appl. No.: 10/782,712

(22) Filed: Feb. 18, 2004
(Under 37 CFR 1.47)

(65) Prior Publication Data

US 2004/0226972 A1 Nov. 18, 2004

Related U.S. Application Data

(60) Provisional application No. 60/448,563, filed on Feb. 18, 2003.

(51) Int. Cl.
*A45C 13/30* (2006.01)
*A41F 3/02* (2006.01)

(52) U.S. Cl. ..... 224/195; 224/660; 224/662; 2/338

(58) Field of Classification Search ..... 224/195, 224/660, 662, 663, 904, 914; D2/639; 2/308, 2/311, 321, 322, 338
See application file for complete search history.

(56) References Cited

U.S. PATENT DOCUMENTS 775,149 A * 11/1904 Righton ..... 224/195
4,747,527 A * 5/1988 Trumpower, II ..... 224/662
5,040,524 A * 8/1991 Votel et al. ..... 224/637
5,236,112 A * 8/1993 Robinson et al. ..... 224/630
5,388,274 A * 2/1995 Glover et al. ..... 2/338
5,464,136 A * 11/1995 Eddy ..... 224/666
5,537,709 A * 7/1996 Taragos ..... 15/222
5,586,969 A * 12/1996 Yewer, Jr. ..... 602/19
5,722,576 A * 3/1998 Rogers ..... 224/195
5,772,576 A * 6/1998 Knighton et al. ..... 600/36
6,193,122 B1 * 2/2001 Buckley ..... 224/270
6,398,092 B1 * 6/2002 Ansley ..... 224/582
6,634,533 B2 * 10/2003 Thompson et al. ..... 224/641
6,701,534 B2 * 3/2004 Guibord ..... 224/904

* cited by examiner

*Primary Examiner*—Nathan J Newhouse
*Assistant Examiner*—Lester L Vanterpool
(74) *Attorney, Agent, or Firm*—Robert L. Shaver; Dykas, Shaver & Nipper, LLP

(57) ABSTRACT

An ergonomic duty belt having a pliable outer covering, a semi-rigid frame member configured to form a semi-conically shaped section when placed about the waist of a user and to conform to the shape of a user's body. This semi conical shape provides for increased ergonomic comfort and decreased pain and discomfort to the wearer of the belt. This duty belt also has an accessory attachment system comprised of generally horizontally extending track portions as well as generally vertically oriented vertical plates. A variety of attachments having attachment portions configured to attach to the track sections and to these vertically oriented plates as well as to a traditional duty belt connect accessories to the duty belt.

11 Claims, 10 Drawing Sheets

ERGONOMIC DUTY BELT

PRIORITY

This application claims the priority date of the provisional application entitled Ergonomic Duty Belt filed by Clifton Cook on Feb. 18, 2003, with Ser. No. 60/448,563, the disclosure of which is herein incorporated by reference.

BACKGROUND OF THE INVENTION

1. Field of the Invention

The present invention generally relates to belts, and more particularly to belts for securing and supporting various accessories about the waist of a user.

2. Background Information

Protective personnel, such as military, law enforcement, and security personnel, require an extensive array of accessories during the performance of their assigned duties. For example, typical law enforcement personnel must carry and have ready access to a wide range of accessories, such as a night stick, flashlight, chemical agent dispenser, handcuffs, communication radio, firearm, and several extra magazines of rounds for the firearm. The total weight for this array of accessories is often between 15 and 25 lbs. Typically, the accessories are attached to a belt worn upon the waist of a user, the belt referred to as a "duty belt" in the art. A typical prior art duty belt is formed from a semi-rigid material, such as leather, having a constant width of 2 to 2.25 inches. Each of these various accessories and tools are attached to the duty belt through the use of loops on the tools which then connect to the duty belt. The loops are coupled to the accessory cases, usually permanently, and the duty belt is then slipped through the loops, coupling the accessories to the duty belt while allowing the position of the accessory cases to be adjusted along the length of the duty belt.

Although previously developed duty belts are effective in coupling accessories to the waist of a user, they are not without their problems. Most notably, previously developed duty belts do not provide for the ergonomic comfort of the user nor do they provide desirable weight distribution of the accessories upon the body of the user. Due to the heavy weight of the accessories, which typically weigh in the range of 15 to 25 lbs. as mentioned above, and due to the non-ergonomic design of previously developed duty belts, many protective personnel have been inflicted with back injuries, discomfort during use, and nerve damage. More specifically, in regard to nerve damage, due to the non-ergonomic design, fairly rigid construction, and limited width of previously developed duty belts, the bottom edge of the duty belt tends to dig in near the hip joint during use. This causes discomfort to the user, and more importantly, puts pressure upon a nerve passing over the hip joint, "pinching" the nerve. The impingement of the duty belt upon the nerve often leads to numbness in the leg(s) and/or nerve damage to the person utilizing the belt.

Further, although the loop attachment systems of previously developed duty belts are effective in coupling the accessory cases upon the duty belt, they are not without their problems. First, the loop encircles the duty belt, thus inserting the material of the loop between the duty belt and the body of the user. The presence of the loop in this location often results in discomfort to the user, and may, if located in the vicinity of a nerve, put pressure upon the nerve, causing discomfort and/or damage. Further still, the loops do not rigidly secure the accessory cases upon the duty belt, allowing the accessory cases to pivot, sway, and rotate and slide upon the belt. This in turn causes user discomfort, uneven weight distribution, impact of the accessories upon the body of the user, and increased difficulty in locating the accessory during an emergency.

Thus, there exists a need for an ergonomic duty belt that is comfortable, reduces nerve damage, aids in the even distribution of weight upon the user, securely holds accessory cases in place, and does not place case securing material, such as loops, between the belt and the user, while also being economical to manufacture, reliable, and able to satisfy the performance expectations of the end user.

Additional objects, advantages and novel features of the invention will be set forth in part in the description which follows and in part will become apparent to those skilled in the art upon examination of the following or may be learned by practice of the invention. The objects and advantages of the present invention may be realized and attained by means of the instrumentalities and combinations particularly pointed out in the appended claims.

SUMMARY OF THE INVENTION

The present invention is an ergonomic duty belt having a pliable outer covering, a semi-rigid frame member; and an accessory retainment system. This belt is configured to form a semi-conically shaped section when placed about the waist of a user. This semi-conically shaped section has a greater circumference near its base and a narrower circumference near its top. This semi conical shape provides for increased ergonomic comfort and decreased pain and discomfort to the wearer of the belt.

The belt is made of multiple foam layers of varying densities and has an inner belt that is configured to go through the belt loops on an officer's pants. The invention also includes an accessory retainment system. In the most simple embodiment of the invention the accessory retainment system is simply a standard prior art duty belt which is attached to the belt by a combination of hook and loop fasteners as well as traditional belt loops that are connected to the ergonomic belt itself. This configuration allows the improved ergonomic belt of the present invention to be coupled with the standard features which currently exist in the prior for attaching belts various accessories to a belt. In addition, a variety of new and inventive connection devices are outlined below. These connection devices may be configured for connection either with the standard outer duty belt, which is then connected to the ergonomic belt or directly upon the ergonomic belt itself.

Various types of retainment systems may be utilized in the present invention. In one embodiment of the invention the ergonomic belt has various attachments which allow the ergonomic belt to be attached to a traditional type duty belt. Various types of attachment devices may then be utilized to connect various accessories to the duty belt, and the combination of the duty belt and the accessories can be held in place upon a user.

In another embodiment of the invention, the accessory retainment system includes vertically disposed plates positioned along an outer surface of the duty belt or of the ergonomic belt. These vertically disposed plates define spaces and gaps that are configured to receive and hold designated portions of a clip like retaining devices between the plates or slotted attachment devices that slip over the vertical plates themselves. The position of this retaining device can be further enhanced by the use of tab or other device that snap fits over the plates or rails. This is particularly effective when the rail has a grooved section or portion that is configured for connection with this tab. In addition, more permanent types of fastening devices such as screws, bolts and rivets may also be used to maintain the devices in position if later removal is not desired.

Each of these retaining devices are configured to hold a compatibly configured accessory such as a handcuff, flashlight or other accessory. While it is to be understood that the exact configuration of the invention can be varied, in some embodiments the configuration of the rails that make up the vertical plates as well as the configuration of the rails that make up a generally horizontally oriented track system are standardized to a common scale such as the so called Picatinny scale or the MIL-STD-1913. This configuration standardizes the features of the present invention and increases the variability and use of the present invention with a variety of other features.

These clip-like retaining devices have a plurality of tabs and connectors that allow the retaining devices to be held in a desired position upon the belt. These retaining devices are also configured to connect and hold a variety of attachment devices such as flashlights, handcuffs, pepper spray, handgun holsters, billy clubs and other devices. The configuration of these retaining devices provides the dual advantage in that they allow these various accessories to be securely connected to the belt while also allowing the various accessories to be selectively removed and replaced from the belt without having to take the belt off and remove all of the other attachment devices from the belt as is taught in the prior art. In other embodiments these vertically disposed plates may be directly connected to the ergonomic portion of the belt, and no other regular duty belt utilized.

Another embodiment of the present invention includes a retaining system comprised of a track that extends in a generally horizontal direction around the belt when the belt is in use. This invention includes semi-rigid retainment frame that is connected to an inner semi-rigid frame member. This retainment frame is comprised of a base portion and an accessory attachment portion that are interconnected by a mid-section portion. The mid-section portion spaces the distance between the base portion and an accessory case thus positioning the accessory case away from the body of the user. The retainment frame is made up of a track having a groove. The track is formed to receive a correspondingly shaped tenon from that is connected in to an accessory case. The placement of the tenon within the track allows accessory to be slid into various positions and held in place through the use of a screw, or other known device. For ease of manufacturing the track is of the same Picatinny scale as the vertical plates which may also be used together with sections of this horizontal track system. This horizontal track configuration allows various attachment devices to be serially placed and slid into position upon the belt.

All of these types of attachment devices provide increased ease of function to a user of the present invention. Depending upon the necessities of the user the exact configuration of the invention may be modified according to their needs. These connecting devices provide various advantages over the prior art in that they allow the various attachments that are typically necessary for use by a police office to be worn with the ergonomic belt that are taught in the present invention. Additionally, these connecting devices also allow modifications and alternative configurations to the variety, connection and assortment of devices that are placed upon the belt.

The purpose of the foregoing abstract is to enable the United States Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The abstract is neither intended to define the invention of the application, which is measured by the claims, nor is it intended to be limiting as to the scope of the invention in any way.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

DESCRIPTION OF THE PREFERRED EMBODIMENTS

Figure 1:
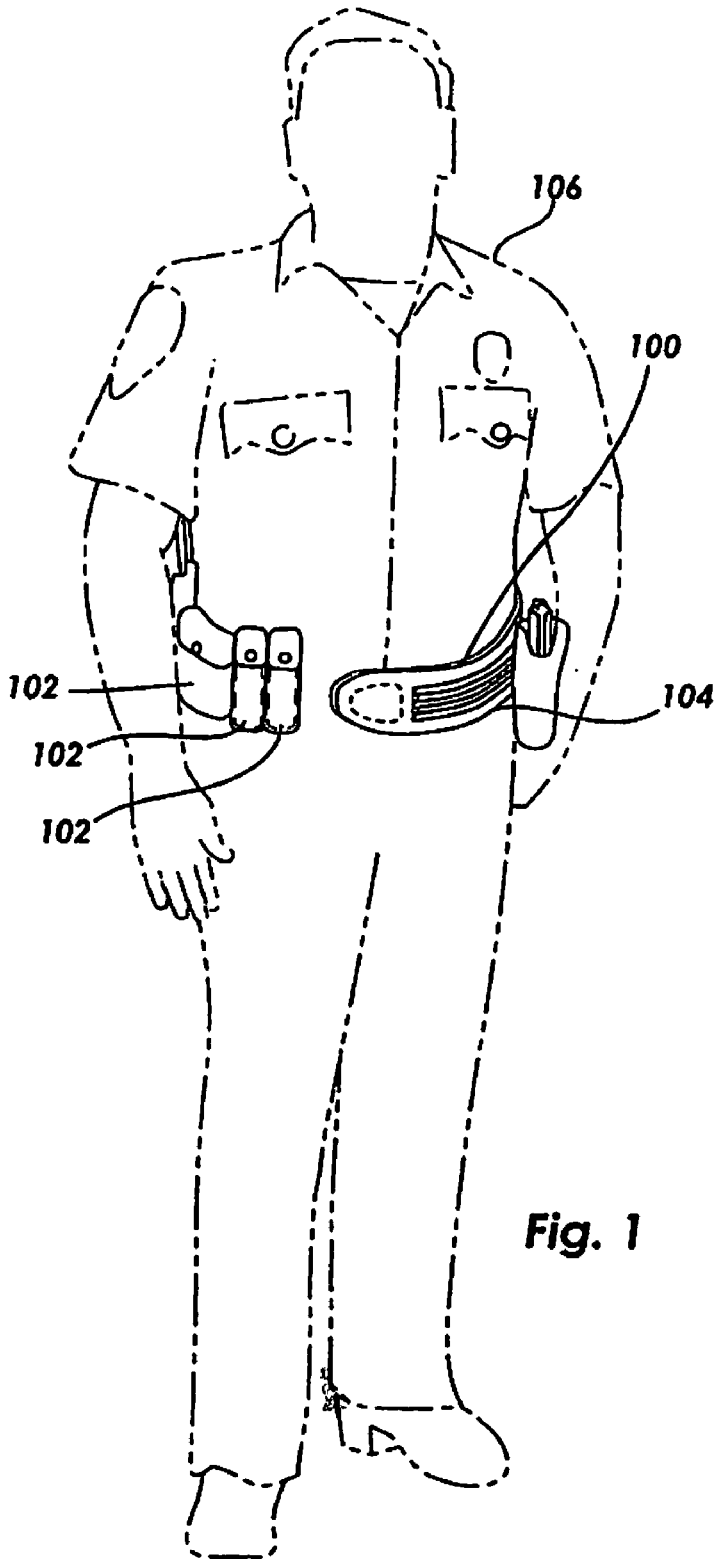
FIG. 1 is a perspective view of one embodiment of an ergonomic duty belt donned by a law enforcement officer (shown in dotted outline) and formed in accordance with one aspect of the present invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

FIGS. 1-14 illustrate one embodiment of an ergonomic duty belt 100 formed in accordance with the present invention. Referring first to FIG. 1, the ergonomic duty belt 100 is designed to comfortably carry a plurality of accessories 102 upon the waist 104 of a user 106. Although it should be apparent to those skilled in the art that the ergonomic duty belt 100 of the present invention is suitable for use with virtually any accessory, for illustrative purposes, the accessories depicted in FIG. 1 represent some of the accessories typically worn by a law enforcement user, and may include such accessories typically worn by a law enforcement user, and may include such accessories as a firearm, extra magazines for the firearm, handcuffs, a flashlight and a radio communication device.

Figure 2:
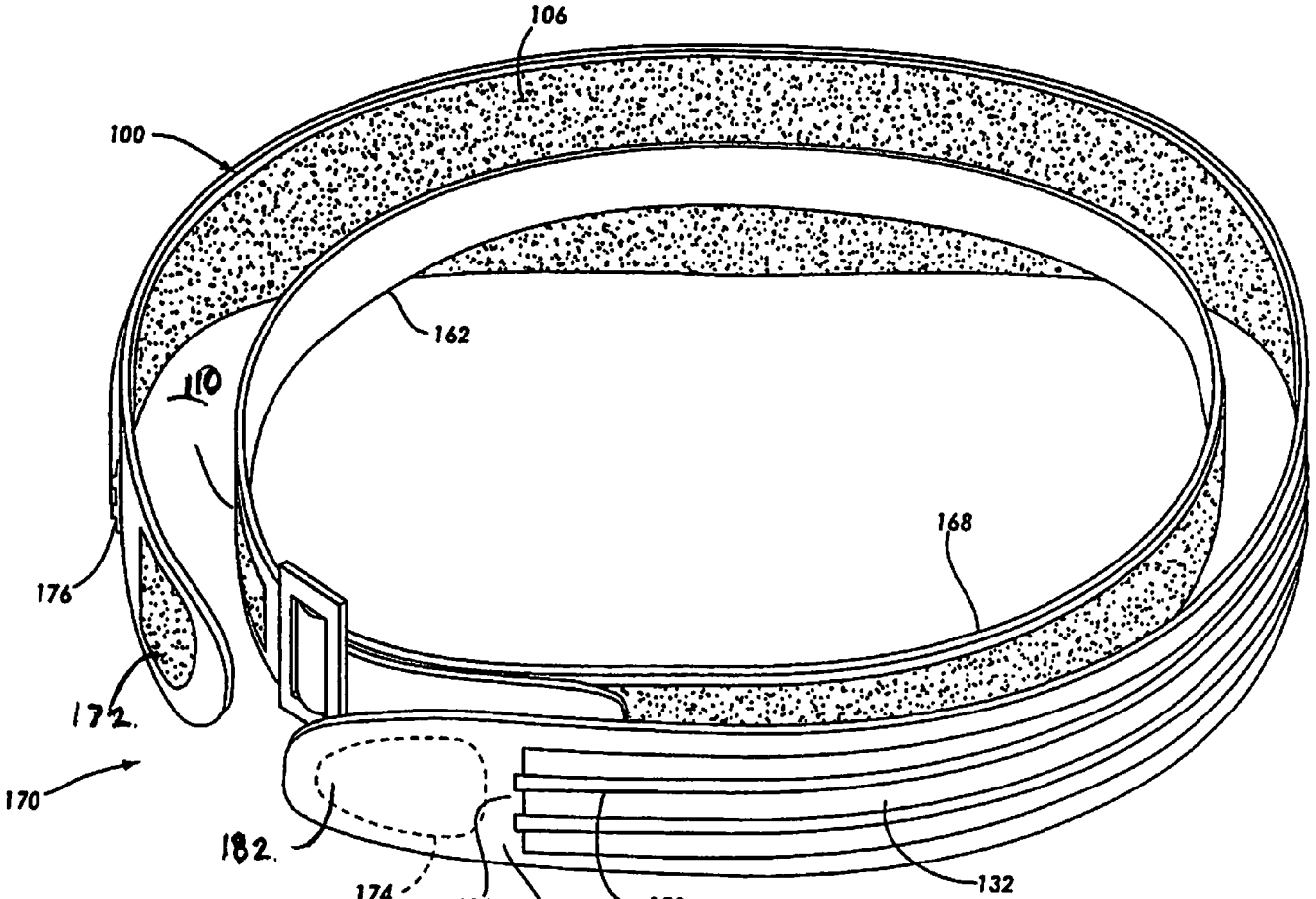
FIG. 2 is a perspective view of the ergonomic duty belt depicted in FIG. 1 shown encircling a liner belt located interior of the ergonomic duty belt.
Figure 3:
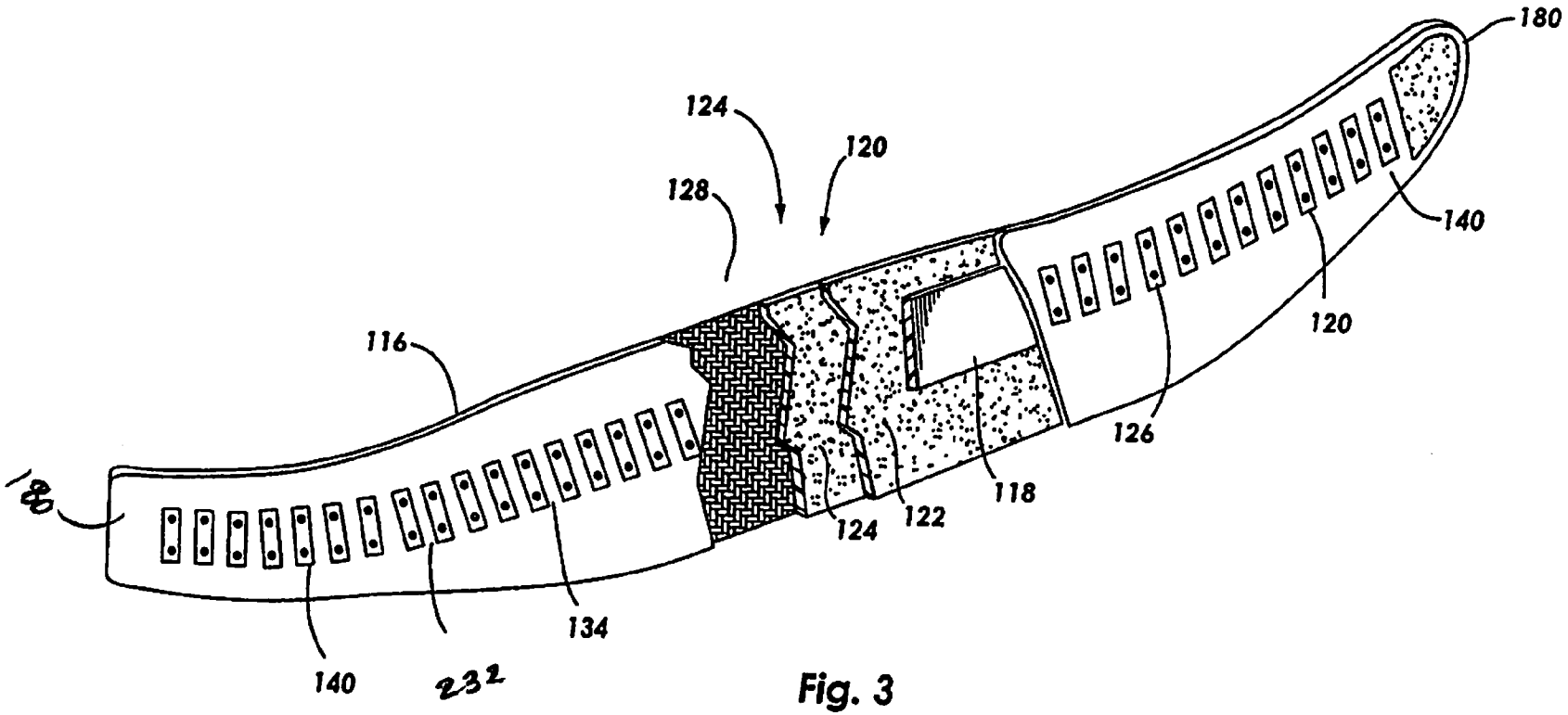
FIG. 3 is a perspective view of the ergonomic duty belt depicted in FIG. 1 shown with portions of an outer layer, inner frame member, closed cell foam layer, and an open cell foam layer selectively removed to better show the interior construction of one embodiment of the ergonomic duty belt of the invention.
Figure 4:
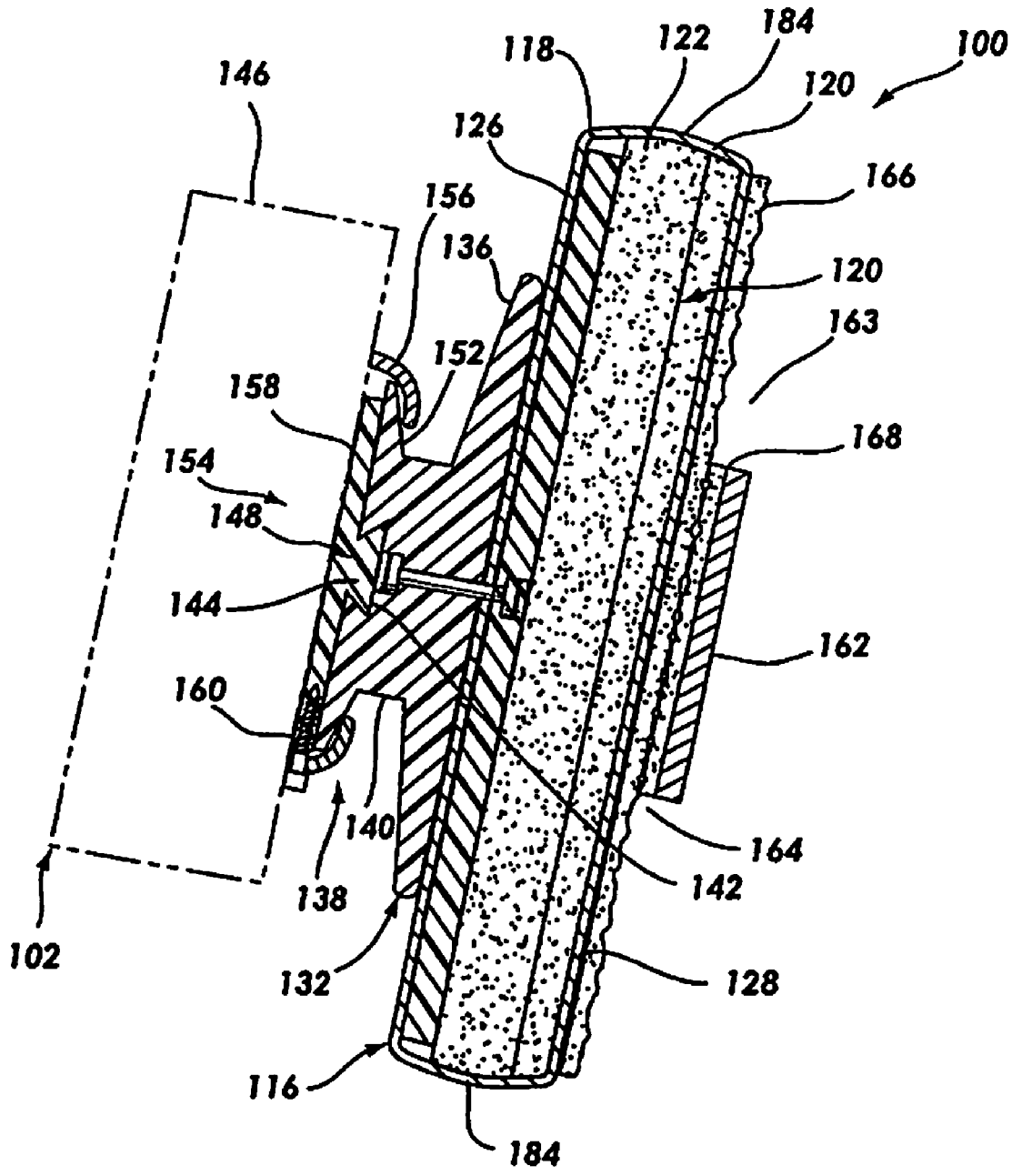
FIG. 4 is a cross sectional view of the ergonomic duty belt shown in FIGS. 1-3.

Referring to FIGS. 2-4, the ergonomic duty belt 100 includes a pliable outer covering 116 enveloping an inner semi-rigid frame member 118 displaced from the body of the user 106 by a pliable cushion layer 120. The cushion layer 120 of the illustrated embodiment is formed from a closed cell foam layer 122 in combination with an open cell foam layer 124. Preferably, the open cell foam layer 124 is positioned inward of the closed cell foam layer 122 so as to be adjacent to the body of the user 106. Arranged as such, the higher moisture absorbent open cell foam is in proximity to the body of the user 106, thereby helping to wick away moisture from the body of the user 106, increasing the comfort level of the user as should be apparent to those skilled in the art.

Further, the forming of the cushion layer 120 with multiple layers 122 and 124 allows the resistance force of the cushion layer 120 to be selectively varied. For example, for the embodiment illustrated in FIGS. 1-4, the open cell foam layer 124 may be formed from foam having a low resilience value, such as resilience values ranging from 1 to 8 lbs. The closed cell foam layer 122 may be formed from a foam having a high resilience value such as resilience values ranging from 2 to 15 lbs. Thus, the layers 122 and 124 work in combination to provide a cushion layer 120 exhibiting variable resilience, thus providing comfortable cushioning characteristics for low level contact forces predominantly through the low resilience value open cell layer 124, and providing comfortable cushioning for high level contact forces predominantly through the high resilience value closed cell layer 122.

The pliable outer covering 116 includes an outer facing surface 126 facing outward from the body of the user and an inner facing surface 128 facing inward toward the body of the user. The outer and inner facing surfaces 126 and 128 are joined to one another about the upper and lower edges of the ergonomic duty belt 100 along a seam 184. In the illustrated embodiment, the outer facing surface 126 is formed from a resilient fabric and the inner facing surface 128 is formed from a mesh fabric to aid in the removal of moisture from the body of the user.

The inner semi-rigid frame member 118 of the ergonomic duty belt 100 provides skeletal support to the duty belt 100, thereby aiding in even weight distribution of the accessories born by the ergonomic duty belt 100. In the preferred embodiment, the frame member 118 is formed from a polyethylene sheet of material die cut into a suitable shape. The frame member 118 runs substantially the entire length of the ergonomic duty belt 100 within the pliable outer covering 116.

Preferably, the frame member 118 is formed in a shape of a frustum, or lamp shade, such that the upper edge of the ergonomic duty belt 100 is located inward of the lower edge of the ergonomic duty belt 100 when worn around the waist of the user 106, or in other words, the lower portion of the inner facing surface 128 of the duty belt 100 is angled outward relative to the centerline of the user. Preferably, the rake of the duty belt 100 is selected to substantially match the outward angle of the protrusion of a user's torso as the torso transitions from the waist to the hips. Moreover, the shape of the frame member 118 is formed to match the contours of the portion of the user's body of which the frame member 118 engages.

Formed as such, the frame member 118 imparts a frustum shape to the ergonomic duty belt 100. Thus, when the ergonomic duty belt 100 is donned by a user, the weight of the accessories 102 and ergonomic duty belt 100 are evenly distributed upon the user. Further, the lower edge of the duty belt is angled outward from the centerline of the user and in conformity to the angle of the hip at the point of contact between the lower edge of the ergonomic duty belt 100 and the hip, thus reducing the stress exerted upon the nerves present in the vicinity of the hip joints.

Focusing further on the shape of the ergonomic duty belt 100, the ergonomic duty belt 100 is marked by a variable width. In previously developed duty belts, the width of the belt remains constant through the entire length of the duty belt, with exception of the tip of one end, which may narrow to aid insertion within a buckle. As noted above, the widths of the duty belt have been standardized and range between 2 inches and 2.25 inches. As best shown in FIG. 3, the illustrated ergonomic duty belt 100 expands from a relatively narrower width, such as from approximately 2 to 4 inches at the distal ends of the ergonomic duty belt 100, to a relatively wider width, such as from approximately 4 to 7 inches at a midpoint located equidistant from the distal ends of the ergonomic duty belt 100. At the points located equidistant between the midpoint and the distal ends, the ergonomic duty belt is designed with an intermediate width, such as a width of approximately 2.5 to 5 inches. By expanding the width of the ergonomic duty belt 100 beyond the standard width, increased contact surface area between the ergonomic duty belt 100 and the body of the user is gained, increasing comfort, weight distribution, and the stability of the accessories upon the user. Further, the increased surface area decreases the pressure load upon the body of the user required to support the weight of the accessories and belt relative to previously developed duty belts, thereby increasing comfort and reducing the potential for nerve damage.

In one embodiment of the invention the ergonomic belt is configured to attach to various accessories 102 through a horizontal rail type system. As is shown in FIGS. 2-4, the rail type attachment system is comprised of a semi-rigid retainment frame 132 coupled to the inner semi-rigid frame member 118. For example this could be done by stitching or by fasteners such as rivets, or other fastening devices such as those that are known in the prior art. In this embodiment of the invention the retainment frame 132 comprises a base portion 136 and an accessory attachment portion 138, coupled to one another by a mid-section portion 140. The mid-section portion 140 provides a separation distance between the base and accessory case 146 thus positioning the accessory away from the body of the user. Positioning the accessory away from the body of the user reduces the impact of the accessory upon the body during use, thus increasing comfort and maneuverability of the user with the accessory belt in place.

As shown in FIG. 4, the attachment system portion 138 of the retainment frame 132 comprises a track 142 shaped in the form of a groove broader at its base than near the outward facing surface of the groove. The track 142 is shaped to receive a correspondingly shaped tenon 144 of the accessory case 146. The tenon 144 being broader at its distal end than near its base. Configured as described, the track 142 interacts with the tenon 144 to form a dovetail joint 148.

As further shown in the representative embodiment of FIG. 4, the attachment system portion 138 may further comprise two wing shaped protrusions 152 extending outward from opposite sides of the retainment frame 132. The protrusions 152 aid in the securing of the accessory case 146 to the retainment frame 132 as will be discussed in further detail below.

Still referring to FIG. 4, the accessory case 146 is designed to house various accessories, such as firearms, extra magazines for the firearm, handcuffs, and/or a radio communication device. In the illustrative embodiment shown in FIG. 4, the accessory case 146 is depicted for housing handcuffs. The accessory case 146 includes an attachment system 154. The attachment system 154 comprises a pair of opposing hooks 156 and a base 158 coupled to the main body of the accessory case 146. The tenon 144 is integrally formed with the base 158 and extends outward therefrom. The hooks 156 are arcuate in shape to engage the backside of the wing shaped protrusions 152, thereby aiding the retainment of the accessory case 146 upon the retainment frame 132. A well known fastener 160 couples at least one of the hooks 156 to the base 158. By rotating the fastener 160, the angle of inclination of the hook 156 may be selectively manipulated, thus permitting the adjustment of the engagement force of the hook 156 upon the wing shaped protrusions 152 of the retainment frame 132. By increasing the engagement force of the hook 156, a user can effectively lock the position of the accessory case 146 in a desired position along the length of the track 142 of the retainment frame 132. Although a specific attachment system 154 is depicted in the illustrated embodiment, it should be apparent to those skilled in the art that alternative attachment systems 154 are suitable for use with the present invention and are within the spirit and scope of the present invention.

In another embodiment of the invention shown in FIGS. 5 and 6 and 12-14. In this embodiment the accessory attachment portions 138 are comprised of generally vertically oriented belt plates 240. These belt plates may be connected to the inner frame portion of the belt 118 through the use of a device such as a fastener, or they may be configured to be sewn to or otherwise connected for use with a traditional type duty belt. These generally vertical plates 240 are configured and connected so as to allow a desired amount of additional spacing to exist between the base portion 232 and the belt plate 240. These belt plates 240 are configured to allow the insertion of complimentarily configured accessory attachment devices to be inserted between the plates 240, so as to from a modified dovetail joint between the attachment devices and the belt plates 240. This combination provides for the appropriate attachment of accessories to the duty belt so as to allow the user to have increased use and flexibility in determining the various devices that are to be attached to the ergonomic belt. The belt plates 240 and the accessory attachment devices 242 are configured to provide the positioning of the various accessories 102 to be away from the body of the user and reduces the impact of the accessory upon the body during use, thus increasing comfort and the maneuverability of the user.

Figure 7:
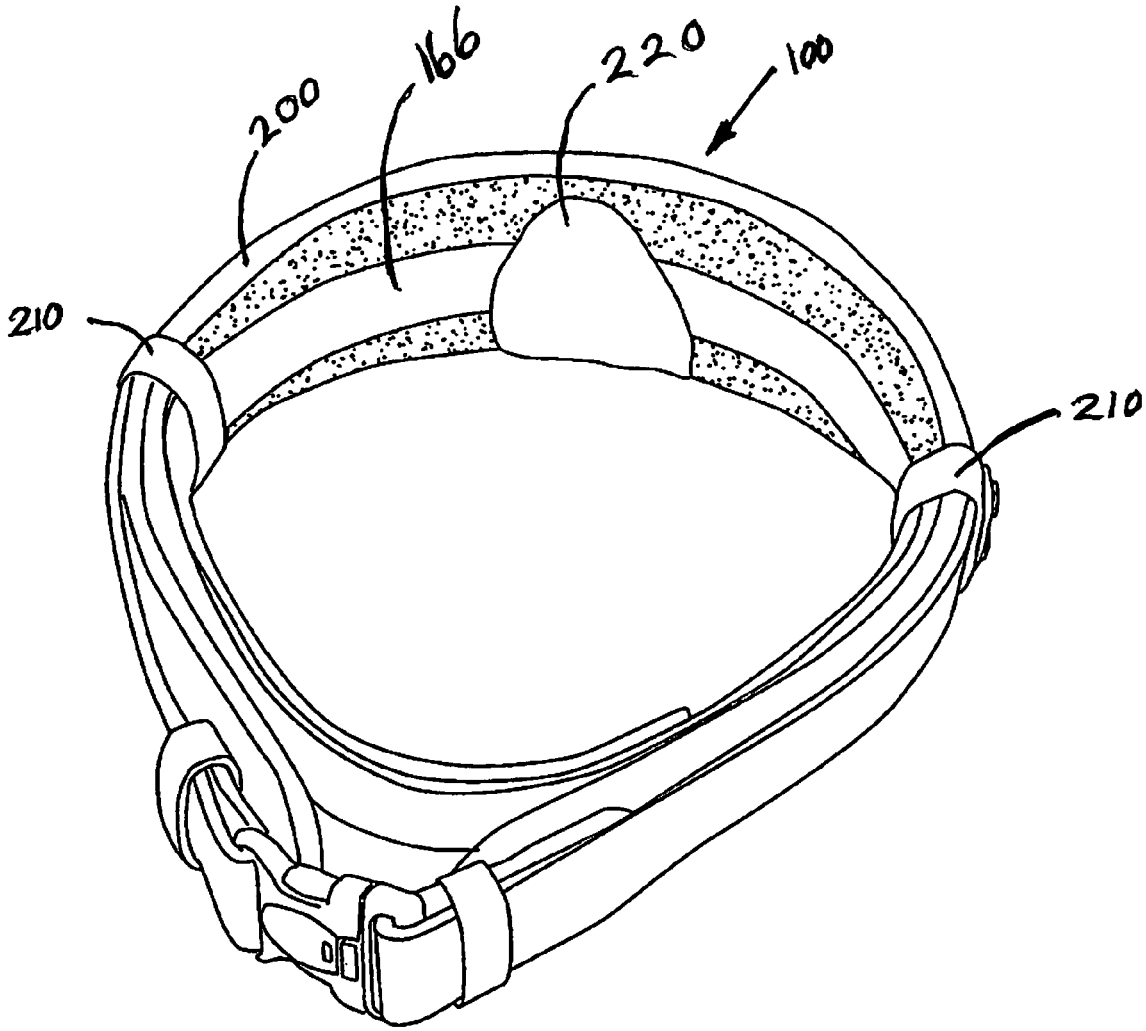
FIG. 7 is a perspective view of another embodiment of the invention including various configurations adapted for connection with a traditional duty belt.

Referring now to FIG. 7, another preferred embodiment of the present invention is shown. In this embodiment, the ergonomic belt of the present invention 100 is configured for connection with a traditional type duty belt 200 such as is found in the prior art. This configuration allows the ergonomic belt system of the present invention to be utilized as a supportive liner together with the duty belt 200 which the officer may be ordinarily more accustomed to using. In this embodiment, the connection between the duty belt 200 and the ergonomic belt 100 is provided by a strip of a hook and loop fastener such as VELCRO®

The duty belt 100 is further connected to the ergonomic belt through the connection of a slidable faster 210 which is configured to surround both the padded ergonomic belt as well as the traditional duty belt. Additionally, a molded loop formed and connected to the thickest portion of the belt holds the duty belt in place and further enables the duty belt to be supported in a desired position and orientation.

The ergonomic belt portion 100 is further configured to have a lumbar pillow 220 that is also configured to connect with the inner portion 166 of the ergonomic belt by the use of a suitable fastener such as a hook and loop fastener. While the connection between the ergonomic belt 100 and various other features such as the duty belt 200 and the lumbar pillow 220 are described as being accomplished by a hook and loop fastener it is to be distinctly understood that the invention is not limited to this form of connection and that a variety of other types of connections both removable and non-removable connections and connecting devices may also be utilized and are considered within the scope of the invention.

Referring now to FIG. 8-11 various views of attachment devices 242 are shown. These devices 242 are configured for connection with the duty belt 200 by slipping over the duty belt 200 in such away so as to hold the device in place. In other embodiments of the present invention these devices and devices similar to them are configured for connection with the vertical plate connecting devices 240. While the embodiment of an attachment device is shown connected to a flashlight, it is to be distinctly understood that the present invention is not limited to any particular accessory or attachment device and that the examples set forth as follows are illustrative only and are not to be construed as limiting in nature.

Figure 8:
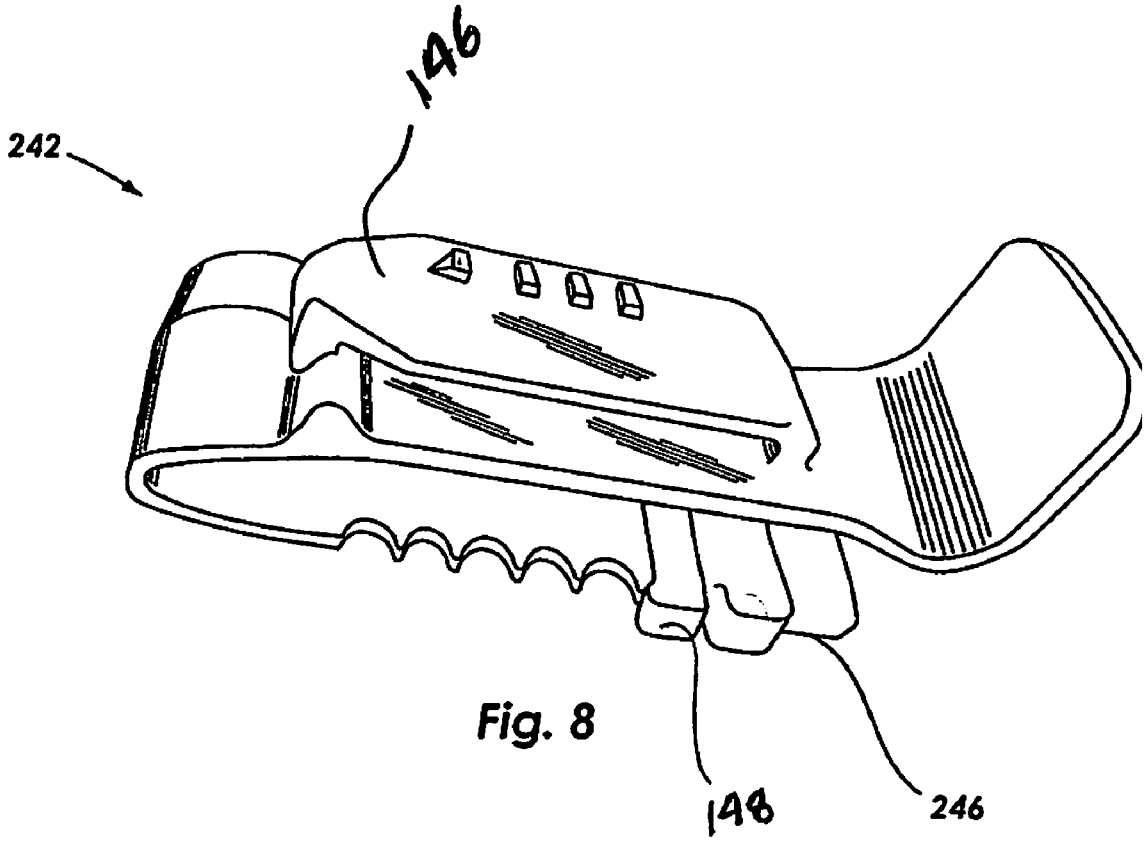
FIG. 8 is a perspective view of the front portion of the attachment device utilized in the preferred embodiment of the present invention.
Figure 9:
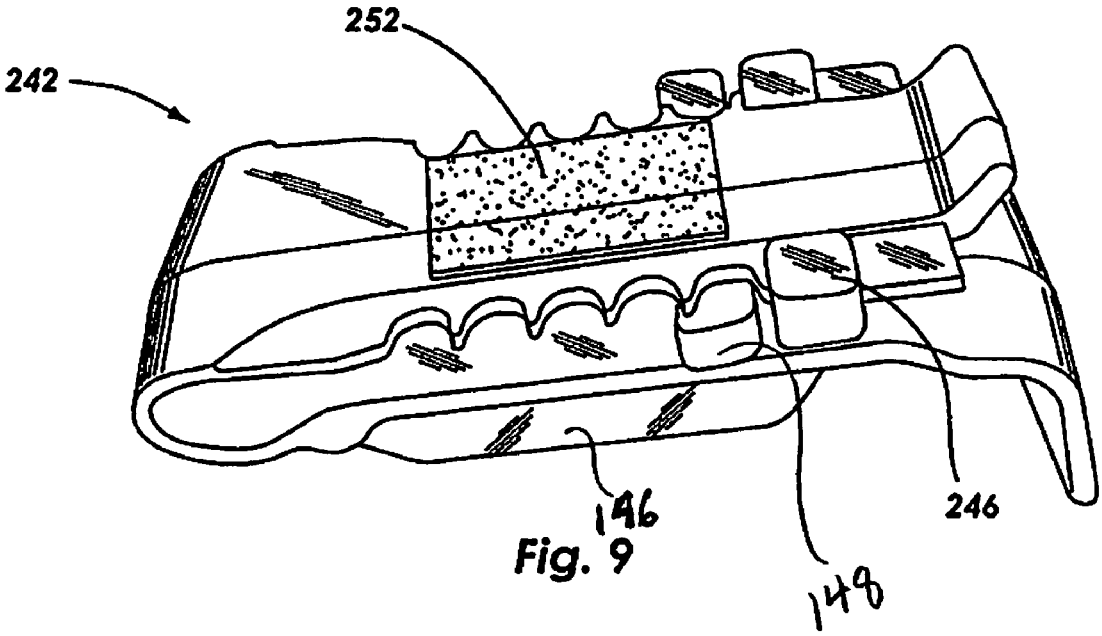
FIG. 9 is a perspective view of the back portion of the attachment device shown in FIG. 8.
Figure 10:
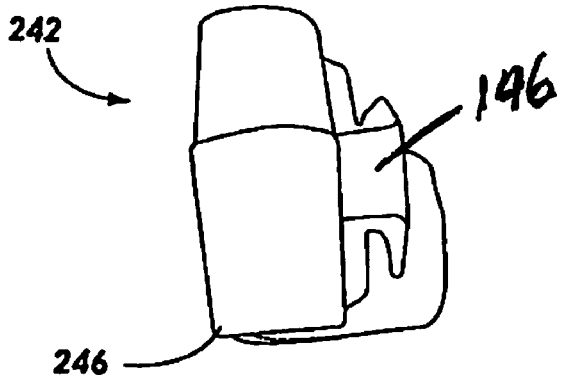
FIG. 10 is a top view of the attachment device shown in FIGS. 7, 8 & 9.
Figure 11:
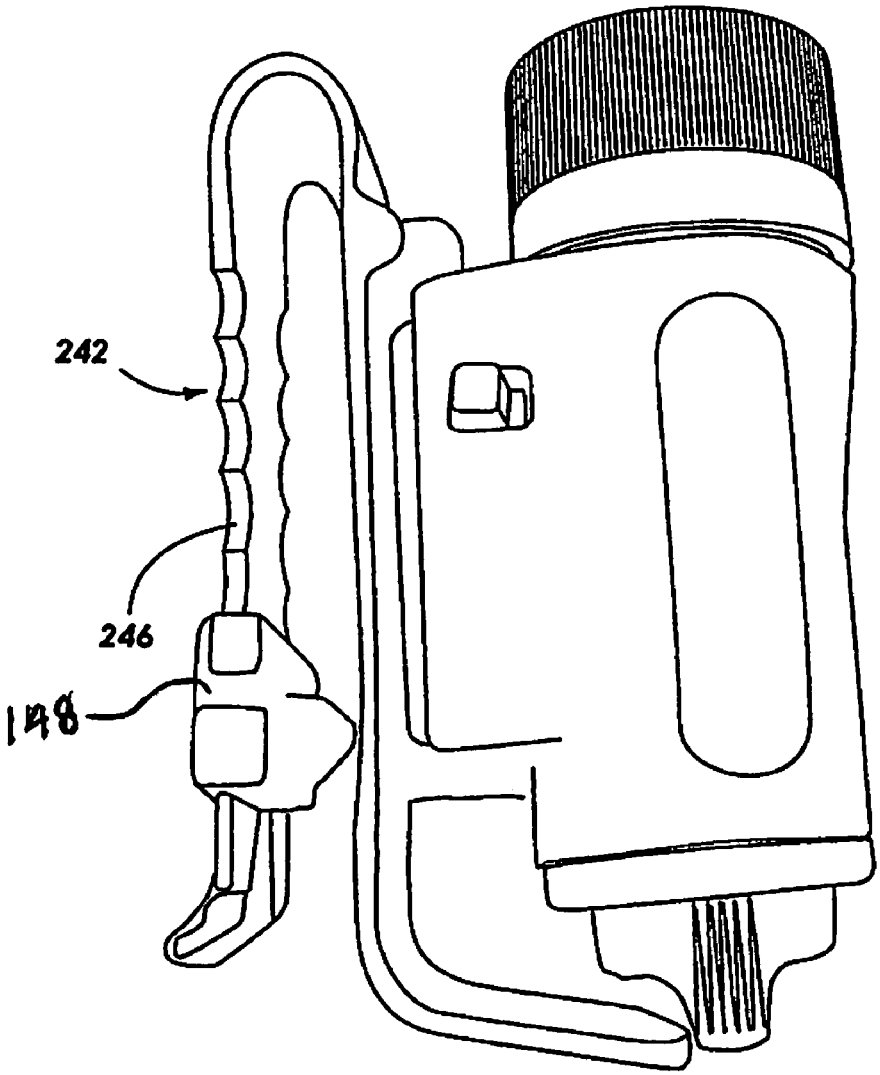
FIG. 11 is a perspective side view of the invention shown in FIGS. 8, 9 with an accessory attached thereto.
Figure 12:
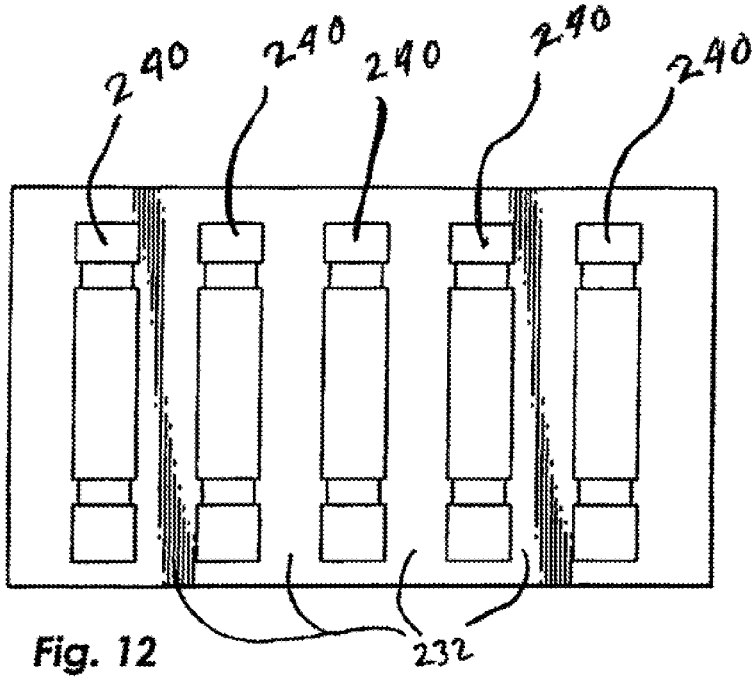
FIG. 12 is a perspective view detail view of the vertical plate connection device shown in the present invention.
Figure 13:
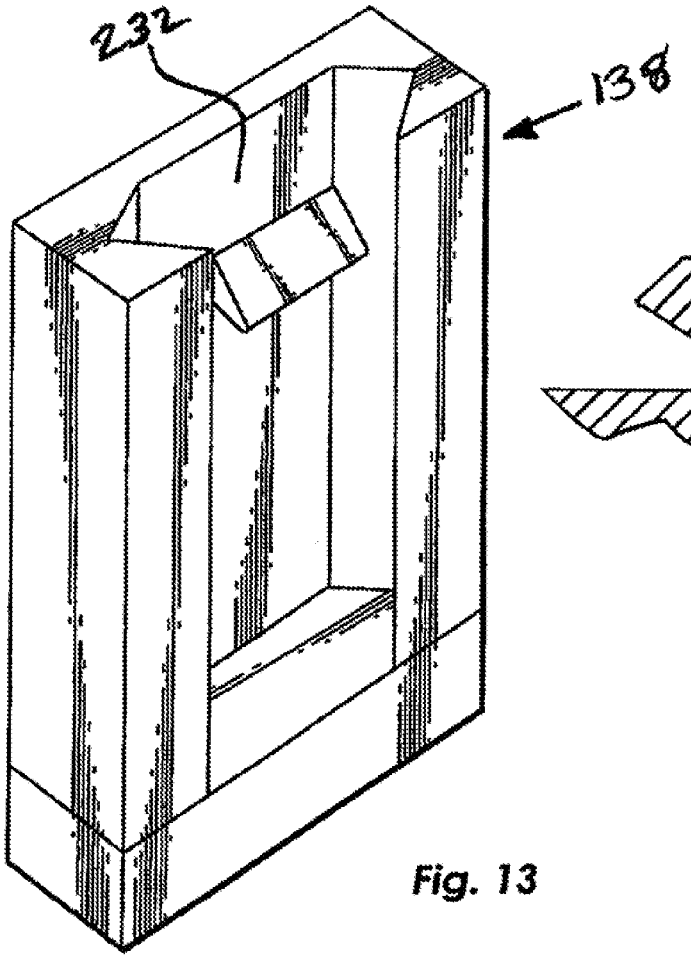
FIG. 13 is a detailed perspective view of the slotted connection device shown described in the specification.
Figure 14:
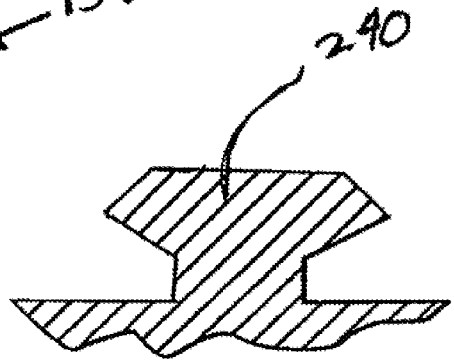
FIG. 14 is a top plan view of the tenon to be inserted into the slotted connection device of FIG. 13.

Referring first to FIG. 8 a perspective view of the accessory attaching device 242 is shown. The accessory attaching portion 242 includes an attachment device tenon 246 which is configured to be inserted between the duty belt 200 and the outer surface 116 of the ergonomic belt 110. These tenons 246 have tabs 148 attached to them which are configured to latch beneath the duty belt 200 and prevent the extraction of the attachment device 242 from the duty belt inadvertently. The connection between the attachment device 242 and the ergonomic belt portion 110 is further enhanced by the placement of an attaching patch 252. This attaching patch 252 is placed and configured so as to connect with a portion of the ergonomic belt preferably a region of material on the inner belt 162 such as hook and loop fastener or another type of material that will adequately form a connection between the attachment device tenon 246 and inner belt 162.

Each of the accessory attachment devices 242 are specifically configured to receive and hold a desired accessory. Therefore while an embodiment of the invention is shown with the attachment of a cylindrically shaped flashlight in place upon the attachment device, it is to be distinctly understood that the invention is not limited thereto but may be variously configured to meet the needs of the user with regard to any particular device.

In the embodiment shown in FIGS. 8-11 the attachment device is configured to provide a horizontally extending shelf support which further assists to support and a hold an accessory in a vertical orientation and position, Various views of the present invention as adapted for use with a flashlight are shown in FIGS. 8-11, however it is to be distinctly understood that the invention is not limited thereto but may be variously adapted and embodied to include various other features as well as those shown and described.

The various accessory cases which may be utilized in conjunction with the accessory attachment device 242 are configured for use with items such as a firearm, extra magazines for the firearm, handcuffs, and/or a radio communication device in addition to the flashlight shown in FIG. 8-11.

Figure 5:
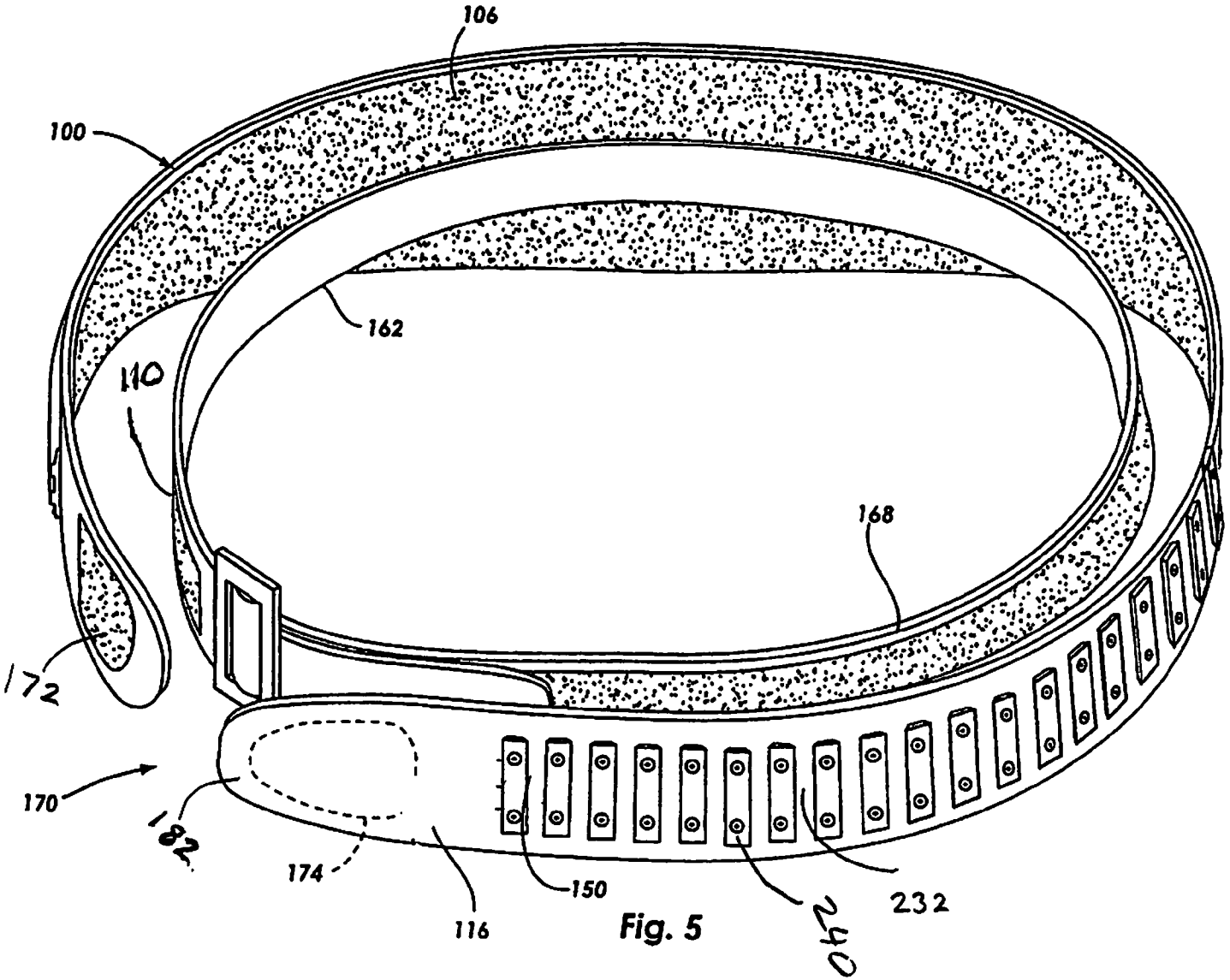
FIG. 5 is a perspective view of one embodiment of the ergonomic duty belt having the preferred second embodiment of the attachment retaining system.
Figure 6:
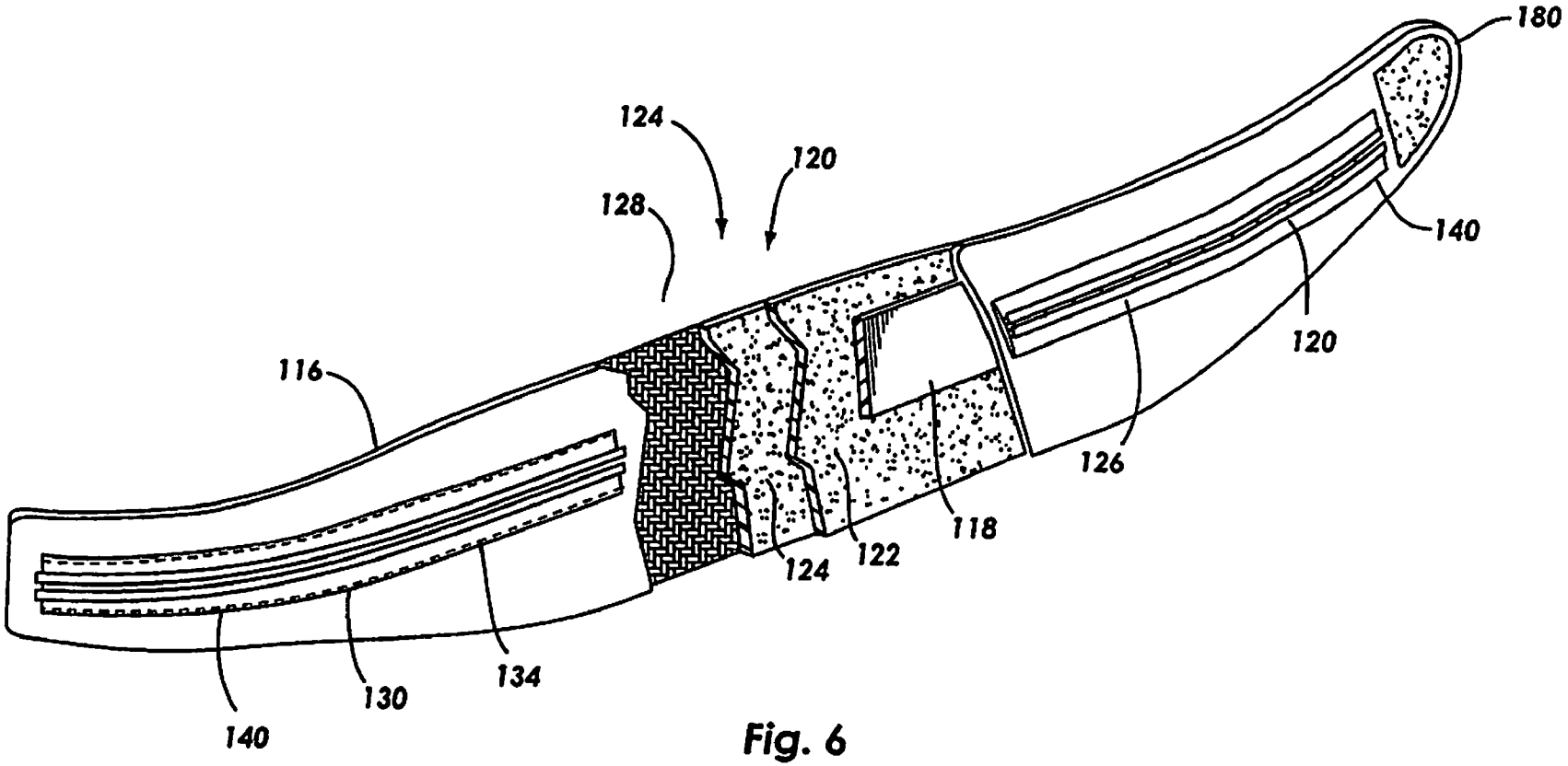
FIG. 6 is a perspective view of the alternative embodiment of the ergonomic duty belt depicted in FIG. 3.

Each of these accessory cases could include an attachment system configured to connect with the accessory tenon 146 shown in FIGS. 5 and 6, or may be otherwise variously embodied to connect to an attachment device 242 utilizing another connection device or system. Although a specific attachment system is depicted in the illustrated embodiment, it should be apparent to those skilled in the art that alternate attachment systems are suitable for use with the present invention and are with in the spirit and scope of the present invention. Such devices include but are not limited to devices that attach utilizing forms tabs, snaps, hook and loop fasteners, various forms of latching devices and other connection and locking devices.

Referring now back to FIGS. 1-14, in one presently preferred embodiment, the ergonomic duty belt 100 further comprises a liner belt coupling system 163 for coupling the ergonomic duty belt 100 to a liner belt 162. In operation, the liner belt 162 is of a sufficiently narrow width as to pass through the belt loops of a pair of trousers, securing the liner belt 162 upon the waist of the user. In turn, the liner belt coupling system 163 permits the ergonomic duty belt 100 to then be coupled to the liner belt 162, thus anchoring the ergonomic duty belt 100 to the liner belt 162 to provide positional stability to the ergonomic duty belt 100 upon the waist of the user. The coupling system 163 in the illustrated embodiment includes a hook and loop fastening assembly 164 formed from hook and loop fastening fabrics, such as VELCRO® hook and loop fastening fabrics.

In the illustrated embodiment, a layer of loop fabric 166 is affixed to the inner facing surface 128 of the ergonomic duty belt 100. A corresponding layer of hook fabric 168 is affixed to an outer facing surface of the liner belt 162. In use, the user first dons the liner belt 100, placing the liner belt 100 through the belt loops of a pair of trousers. The user then selects the appropriate position of the ergonomic duty belt 100 upon the body, and presses the ergonomic duty belt 100 upon the liner belt 162, thereby engaging the layer of loop fabric 166 with the layer of hook fabric 168, coupling the ergonomic duty belt 100 to the liner belt 162. As should be apparent to those skilled in the art, although a specific coupling system 163 is depicted in the illustrated embodiment, it should be apparent to one skilled in the art that other coupling systems are suitable for use with the present invention, such as removable fastener clips, etc.

The ergonomic duty belt 100 further comprises a belt ends securing assembly 170 for securing a first end 180 of the ergonomic duty belt 100 to a second end 182 of the ergonomic duty belt 100. In the illustrated embodiment, the belt ends securing assembly 170 comprises a segment of loop fabric 172 affixed to the outer facing surface of a first end 180 of the ergonomic duty belt 100. A corresponding segment of hook fabric 174 is affixed to the inner facing surface of a second end 182 of the ergonomic duty belt 100. In operation, the user selects the appropriate position of the ends of the ergonomic duty belt 162 relative to one another, and presses the loop fabric 172 into the hook fabric 174, coupling the ends 180 and 182 of the ergonomic duty belt 100 to one another. As should be apparent to those skilled in the art, although a specific belt ends securing assembly 170 is depicted in the illustrated embodiment, it should be apparent to one skilled in the art that other coupling systems are suitable for use with the present invention, such as a well known buckle.

In light of the above description of the structural components of the ergonomic duty belt 100, the detailed description will now focus on the operation of the ergonomic duty belt 100. In operation, a user fastens the duty belt 100 around the waist of the user and to the liner belt 162 as described above for use. The belt is then loaded by placing designated attachment devices 142 in various desired positions around the duty belt by slipping these attachment devices between the plates 140 that already exist upon the device. If so desired this step of placing the attachment devices upon the belt may also be performed prior to the placement of the belt upon the user. Once the attachment devices 142 are in place upon the belt the various accessory cases may then be attached to the attachment device 142. In some embodiments the cases of all of the accessories may be the same thus allowing for increased interchangeability between upon the device itself. In the event that these attachment devices need to be changed this can be accomplished by simply removing an individual attachment device 142 and replacing this device in another location upon the belt.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. An ergonomic duty belt for carrying accessories, said duty ergonomic belt designed for wear by a human user wearing pants with belt loops, comprising:

a liner belt sized for passage through belt loops, said liner belt having a longitudinal axis parallel with the long dimension of said liner belt, a transverse axis generally perpendicular to said longitudinal axis, an inner face, said inner face for placement adjacent the user of said ergonomic duty belt when said ergonomic duty belt is in use, an outer face for placement away from the body of said user when said ergonomic duty belt is in use;

an outer belt having a longitudinal axis parallel with the long dimension of said outer belt, a transverse axis generally perpendicular to said longitudinal axis, an inner face, said inner face for placement adjacent the outer face of said liner belt, an outer face for placement away from the body of said user when said ergonomic duty belt is in use, with said outer belt being removably attachable to said liner belt;

an inner cushion layer adjacent the inner face of said outer belt, said inner cushion layer formed of open cell foam configured to wick moisture away from said user;

an outer cushion layer, said outer cushion layer located adjacent said inner cushion layer, said outer cushion layer formed of closed cell foam configured to provide a resilient pad between said user and accessories on said ergonomic duty belt;

a semi-rigid frame member attached to and adjacent to said outer cushion layer;

a pliable outer covering, said pliable outer covering which covers said semi-rigid frame member, said outer cushion layer, and said inner cushion layer; and an accessory attachment system attached to said semi-rigid frame member, for attachment of accessories.

2. The ergonomic duty belt of claim 1 in which said semi-rigid frame member is cut in the shape of a frustum of a cone, said semi-rigid frame member having a smaller length at its top and a longer length at the bottom, said semi-rigid frame member shaped to fit the waist contours of said user's body.

3. The ergonomic duty belt of claim 1 where said outer cushion layer is narrower in the area adjacent said user's hips and wider in the region of said user's back, with said variable width configured to provide increased comfort combined with decreased pressure load upon the body of said user.

4. The ergonomic duty belt of claim 1 where said inner face of said pliable outer cover is constructed of a mesh material, said mesh material configured to aid removal of moisture from said user.

5. An ergonomic duty belt for carrying accessories, said ergonomic duty belt designed for wear by a human user wearing pants with belt loops, comprising:

a liner belt sized for passage through belt loops, said liner belt having a longitudinal axis parallel with the long dimension of said belt, a transverse axis generally perpendicular to said longitudinal axis, an inner face, said inner face for placement adjacent the user of said ergonomic duty belt when said belt is in use, an outer face for placement away from the body of said user when said ergonomic duty belt is in use;

an outer belt having a longitudinal axis parallel with the long dimension of said outer belt, a transverse axis generally perpendicular to said longitudinal axis, an inner face, said inner face for placement adjacent the outer face of said liner belt, an outer face for placement away from the body of said user when said ergonomic duty belt is in use, with said outer belt being removably attachable to said liner belt;

an inner cushion layer adjacent the inner face of said outer belt, said inner cushion layer formed of open cell foam configured to wick moisture away from said user;

an outer cushion layer, said outer cushion layer located adjacent said inner cushion layer, said outer cushion layer formed of closed cell foam to provide a resilient pad between said user and accessories on said ergonomic duty belt, said outer cushion layer narrower adjacent said user's hips and wider in the region of said user's back, with said variable width configured to provide increased comfort combined with decreased pressure load upon the body of said user;

a semi-rigid frame member attached to and adjacent to said outer cushion layer, with said semi-rigid frame member cut in the shape of a frustum of a cone, said semi-rigid frame member having a smaller length at its top and a longer length at the bottom, said semi-rigid frame member shaped to fit the waist contours of said user's body;

a pliable outer covering, said pliable outer covering which covers said semi-rigid frame member, said outer cushion layer, and said inner cushion layer, an inner face of said pliable outer cover is constructed of a mesh material, said mesh material configured to aid removal of moisture from said user; and an accessory attachment system attached to said semi-rigid frame member, for attachment of accessories.

6. An ergonomic duty belt for carrying accessories, said duty belt designed for wear by a human user wearing pants with belt loops, comprising:

a liner belt sized for passage through belt loops, said liner belt having a longitudinal axis parallel with the long dimension of said belt, a transverse axis generally perpendicular to said longitudinal axis, an inner face, said inner face for placement adjacent the user of said ergonomic duty belt when said belt is in use, an outer face for placement away from the body of said user when said ergonomic duty belt is in use;

an outer belt having a longitudinal axis parallel with the long dimension of said outer belt, a transverse axis generally perpendicular to said longitudinal axis, an inner face, said inner face for placement adjacent the outer face of said liner belt, an outer face for placement away from the body of said user when said ergonomic duty belt is in use, with said outer belt being removably attachable to said liner belt, said outer belt comprising;

an inner cushion layer adjacent the inner face of said outer belt, said inner cushion layer formed of open cell foam configured to wick moisture away from said user;

an outer cushion layer, said outer cushion layer located adjacent said inner cushion layer, said outer cushion layer formed of closed cell foam configured to provide a resilient pad between said user and accessories on said ergonomic duty belt;

a semi-rigid frame member attached to and adjacent to said outer cushion layer;

a pliable outer covering, said pliable outer covering which covers said semi-rigid frame member, said outer cushion layer, and said inner cushion layer with liner belt and outer belt configured for attachment to each other and to a duty belt on the outer face of said outer belt.

7. The ergonomic duty belt of claim 6 in which said outer belt is cut in the shape of a frustum of a cone, said outer belt having a shorter length at its top edge and a longer length at the bottom edge, said outer belt shaped to fit the waist contours of said user's body.

8. The ergonomic duty belt of claim 6 where said outer cushion layer is narrower in the area adjacent said user's hips and wider in the region of said user's back, with said variable width configured to provide increased comfort combined with decreased pressure load upon the body of said user.

9. The ergonomic duty belt of claim 6 which further comprises a lumbar pillow removably attached to a midpoint of said outer belt, configured to form a supporting feature on said inside of said outer belt.

10. An ergonomic duty belt for carrying accessories, said ergonomic duty belt designed for wear by a human user wearing pants with belt loops, comprising:

a liner belt sized for passage through belt loops, said liner belt having a longitudinal axis parallel with the long dimension of said belt, a transverse axis generally perpendicular to said longitudinal axis, an inner face, said inner face for placement adjacent the user of said ergonomic duty belt when said belt is in use, an outer face for placement away from the body of said user when said ergonomic duty belt is in use;

an outer belt having a longitudinal axis parallel with the long dimension of said outer belt, a transverse axis generally perpendicular to said longitudinal axis, an inner face, said inner face for placement adjacent the outer face of said liner belt, an outer face for placement away from the body of said user when said ergonomic duty belt is in use, with said outer belt being removably attachable to said liner belt, said outer belt comprising;

an inner cushion layer adjacent the inner face of said outer belt, said inner cushion layer formed of open cell foam configured to wick moisture away from said user;

an outer cushion layer, said outer cushion layer located adjacent said inner cushion layer, said outer cushion layer formed of closed cell foam to provide a resilient pad between said user and accessories on said ergonomic duty belt, where said outer cushion layer is narrower in the area adjacent said user's hips and wider in the region of said user's back, with said variable width configured to provide increased comfort combined with decreased pressure load upon the body of said user;

a semi-rigid frame member attached to and adjacent to said outer cushion layer, in which said semi-rigid frame member is cut in the shape of a frustum of a cone, said semi-rigid frame member having a smaller length at its top and a longer length at the bottom, said semi-rigid frame member shaped to fit the waist contours of said user's body;

a pliable outer covering, said pliable outer covering which covers said semi-rigid frame member, said outer cushion layer, and said inner cushion layer;

with said inner and outer belts when attached to each other configured to attach to a semi-rigid duty belt positioned on an exterior of said outer belt, said duty belt for attachment of accessories; and a lumbar pillow removably attached to a midpoint of said outer belt, configured to form a supporting feature on said inside of said ergonomic duty belt.

11. The ergonomic duty belt of claim 10 which further comprises a plurality of slidable fasteners sized to surround said outer belt and said semi-rigid duty belt, said slidable fasteners configured to adjustably secure said outer belt to said semi-rigid duty belt.

* * * * *